US009728366B2

(12) United States Patent
Guillanton et al.

(10) Patent No.: US 9,728,366 B2
(45) Date of Patent: Aug. 8, 2017

(54) SEALED FUSE HOLDER

(71) Applicant: DELPHI INTERNATIONAL OPERATIONS LUXEMBOURG S.A.R.L., Bascharage (LU)

(72) Inventors: Erwan Guillanton, Epernon (FR); Aymeric Perot, Epernon (FR)

(73) Assignee: Delphi International Operations Luxembourg, Sarl, Luxembourg (LU)

( * ) Notice: Subject to any disclaimer, the term of this patent is extended or adjusted under 35 U.S.C. 154(b) by 0 days.

(21) Appl. No.: 15/103,096

(22) PCT Filed: Dec. 17, 2014

(86) PCT No.: PCT/EP2014/078323
§ 371 (c)(1),
(2) Date: Jun. 9, 2016

(87) PCT Pub. No.: WO2015/091704
PCT Pub. Date: Jun. 25, 2015

(65) Prior Publication Data

US 2016/0307720 A1 Oct. 20, 2016

(30) Foreign Application Priority Data

Dec. 19, 2013 (FR) ..... 13 63104

(51) Int. Cl.
*H01H 85/22* (2006.01)
*H01H 85/00* (2006.01)
(Continued)

(52) U.S. Cl.
CPC ..... *H01H 85/22* (2013.01); *H01H 85/0026* (2013.01); *H01H 85/201* (2013.01);
(Continued)

(58) Field of Classification Search
CPC H01R 13/684; H01R 13/506; H01R 13/5221; H01H 85/22; H01H 85/0026; H01H 85/201; H01H 85/24
(Continued)

(56) References Cited

U.S. PATENT DOCUMENTS 3,356,806 A * 12/1967 Urani ..... H01H 85/201 337/192
3,417,359 A * 12/1968 Urani ..... H01H 85/201 337/201
(Continued)

FOREIGN PATENT DOCUMENTS

GB 2094077 A * 9/1982 ..... H01H 85/201

*Primary Examiner* — Tulsidas C Patel
*Assistant Examiner* — Travis Chambers
(74) *Attorney, Agent, or Firm* — Robert J. Myers

(57) ABSTRACT

The invention relates to a fuse holder comprising two housing elements which, once assembled, together form a tube in which a fuse is accommodated. The first housing element includes a base extending longitudinally along the direction of assembly of the two housing elements with each other. A seal is placed on the base mainly in a plane perpendicular to the direction of assembly. During assembly, the second housing element is brought to at least partially cover the base to sandwich the seal between the two housing elements. A rim extends around the base in the direction of assembly in order to protect the seal until the two housing elements are assembled together.

7 Claims, 2 Drawing Sheets

(51) Int. Cl.

| | |
|---|---|
| ***H01H 85/20*** | (2006.01) |
| ***H01H 85/24*** | (2006.01) |
| ***H01R 13/506*** | (2006.01) |
| ***H01R 13/52*** | (2006.01) |
| *H01H 85/54* | (2006.01) |

(52) U.S. Cl.
CPC ..... *H01H 85/24* (2013.01); *H01R 13/506* (2013.01); *H01R 13/5221* (2013.01); *H01H 85/203* (2013.01); *H01H 85/547* (2013.01)

(58) Field of Classification Search
USPC .... 439/620.29, 620.28, FOR. 101, FOR. 102
See application file for complete search history.

(56) References Cited

U.S. PATENT DOCUMENTS

| | | | | | |
|---|---|---|---|---|---|
| 4,909,761 | A * | 3/1990 | Muguira | H01H 85/201 | 337/201 |
| 5,267,879 | A * | 12/1993 | Oakley | H01H 85/62 | 439/620.28 |
| 5,648,749 | A * | 7/1997 | Lin | H01H 85/201 | 337/192 |
| 5,888,098 | A * | 3/1999 | Cheng | H01H 85/201 | 439/620.28 |
| 8,454,390 | B2 * | 6/2013 | Darr | H01H 85/202 | 337/201 |
| 2012/0289086 | A1 * | 11/2012 | Jetton | H01H 85/0026 | 439/587 |
| 2013/0037294 | A1 * | 2/2013 | Blaha | H01H 85/0026 | 174/50 |

* cited by examiner

SEALED FUSE HOLDER

CROSS-REFERENCE TO RELATED APPLICATION

This application is a national stage application under 35 U.S.C. §371 of PCT Application Number PCT/EP2014/078323 having an international filing date of Dec. 17, 2014, which designated the United States, said PCT application claiming the benefit of priority under Article 8 of the Patent Cooperation Treaty to French Patent Application No. 1363104, having a filing date of Dec. 19, 2013, the entire disclosure of each of which are hereby incorporated herein by reference.

TECHNICAL FIELD OF THE INVENTION

The invention concerns the field of fuse holders, and notably fuse holders for automotive applications.

BACKGROUND OF THE INVENTION

In particular, fuse holders of this type can be used to protect charging circuits of electric vehicles. These fuses are advantageously placed as far upstream as possible in the charging circuit, for example at the level of the charging socket, in order to protect the vehicle and any occupants from a short-circuit, overheating, or even a fire. In this type of circuit the fuses are located outside the passenger compartment, and therefore exposed to inclement weather, water jets, etc.

Given the importance of the protection role of these fuses, improvements to these fuses in order to increase their efficacy and reliability are looked for.

BRIEF SUMMARY OF THE INVENTION

To this end, there is provided in accordance with the invention a fuse holder including two housing elements. Each element being one-piece. For example, once assembled, these two housing elements form a tube closed at each of its ends. They then make it possible to accommodate a fuse. A plurality of fuses may be accommodated in parallel between two housing elements. Each fuse includes two connecting terminals. Each housing element includes a contact intended to make an electrical connection with one of these terminals. To be more precise, two contacts are provided for each fuse, each situated in a respective housing element. Each contact is then intended to establish an electrical connection with one of the two connecting terminals of a fuse. Each contact is electrically connected, for example crimped and/or soldered, to a cable. Each housing element includes a passage for this cable or these cables and a wire seal to provide the seal between the external insulating sheath of each cable and this passage. In the case of a fuse holder receiving a single fuse, this seal may be an individual wire seal. Otherwise, an individual wire seal may be provided for each cable or a seal common to a plurality of cables, including a passage for each cable.

One of the two housing elements includes a cap, intended to receive a fuse and extending longitudinally in a direction of assembly of the two housing elements to each other. This housing element further includes an interfacial seal disposed on the cap. This is an O-ring seal, for example, which lies essentially in a plane perpendicular to the assembly direction. This interfacial seal is covered by the other housing element when the two housing elements are assembled together. The interfacial seal is therefore sandwiched between the two housing elements. To be more precise, the interfacial seal is sandwiched between the outside surface of the cap of one of the housing elements and the inside surface of the other housing element.

The fuse or fuses accommodated in the fuse holder is or are therefore in a sealed area.

In order to protect the interfacial seal, for example when the two housing elements are not assembled together, a rim may be provided that is molded integrally with one of the housing elements and extends on the one hand all around the cap and on the other hand in the direction of assembly of the two housing elements together. The rim then overlies the interfacial seal.

In order to retain the interfacial seal on the housing element on which it is mounted, notably when the housing elements are not assembled together, for example during transportation and delivery phases, a seal retaining feature be provided for retaining this interfacial seal. This feature makes it possible to ship the fuse holder with a support pre-mounted on one housing element and with a seal already fitted thereto, while the contacts, the cables and the fuse will be mounted only at a later stage.

The seal retaining feature is, for example, removable and/or mobile between an open position and a closed position. In the open position of the seal retaining feature, the interfacial seal can slide relatively freely on a portion of the cap. In the closed position of the seal retaining feature, the movement of the interfacial seal on the cap is more limited and essentially remains under the rim, or at least in an area sufficiently close thereto for the rim to make access to the interfacial seal more difficult. The seal retaining feature for the interfacial seal may for example be integral with a support in which a fuse is accommodated. Accordingly, two functions (interfacial seal retention and fuse support) are provided by a single element that renders the processes of fabrication and assembly of the fuse holder in accordance with the invention simpler and more economic. The open position of the seal retaining feature enables the insertion of a fuse on the support and their closed position enables the connection of that fuse with a contact.

In order for the housing elements to remain assembled together, a locking feature may be provided part of which is situated on one of the housing elements and another part of which is situated on the other housing element. These two parts then inter-engage, for example clip together, to lock the housing elements when they are assembled together. In order to protect this locking feature from impacts or unintentional unlocking, they may be at least partly covered and protected by the rim.

To facilitate fitting the interfacial seal a beveled surface may be provided on one of the housing elements. This beveled surface is situated at least in part under the rim. It is flared in an assembly direction corresponding to the insertion of a portion of the other housing element under the rim. This beveled surface then forms a ramp for sliding the interfacial seal on the cap during assembly of the housing elements with each other from the position in which it was retained by the seal retaining feature to a position in which it rests on a seating with which it establishes a sealed contact.

To accommodate the interfacial seal there may be provided on one of the housing elements a flared opening in which are inserted the seating and the seal situated on the other housing element. This avoids having to produce a groove on the cap the molding of which would then have been incompatible with the production of the rim.

BRIEF DESCRIPTION OF THE SEVERAL VIEWS OF THE DRAWING

Other features and advantages of the invention will become apparent on reading the following detailed description and from the appended drawings. In these drawings.

DETAILED DESCRIPTION OF THE INVENTION

Figure 1:
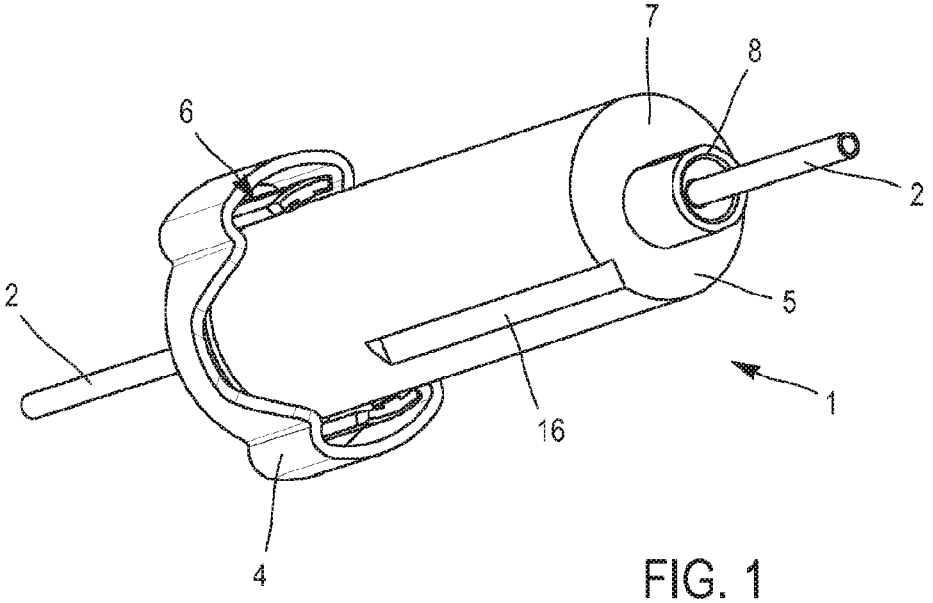
FIG. 1 represents diagrammatically in perspective one embodiment of a fuse holder in accordance with the invention.

One example of a fuse holder 1 is represented in FIG. 1. That fuse holder 1 is inserted between two cable portions 2, in an electrical circuit, such as a charging circuit of an electric vehicle. Each cable portion 2 is electrically connected, for example crimped or soldered, to a contact 3 (for example a Delphi female DCS1 contact 6.3 that can be seen in FIGS. 4 and 5). Each contact 3 is accommodated in a housing element 4, 5. A first housing element 4 includes locking feature 6 for retaining the second housing element 5, forming a cover. Once assembled, the first housing element 4 and the second housing element 5 form a tube closed at each of its ends by a wall 7 including a passage 8 for each cable portion 2.

Figure 2:
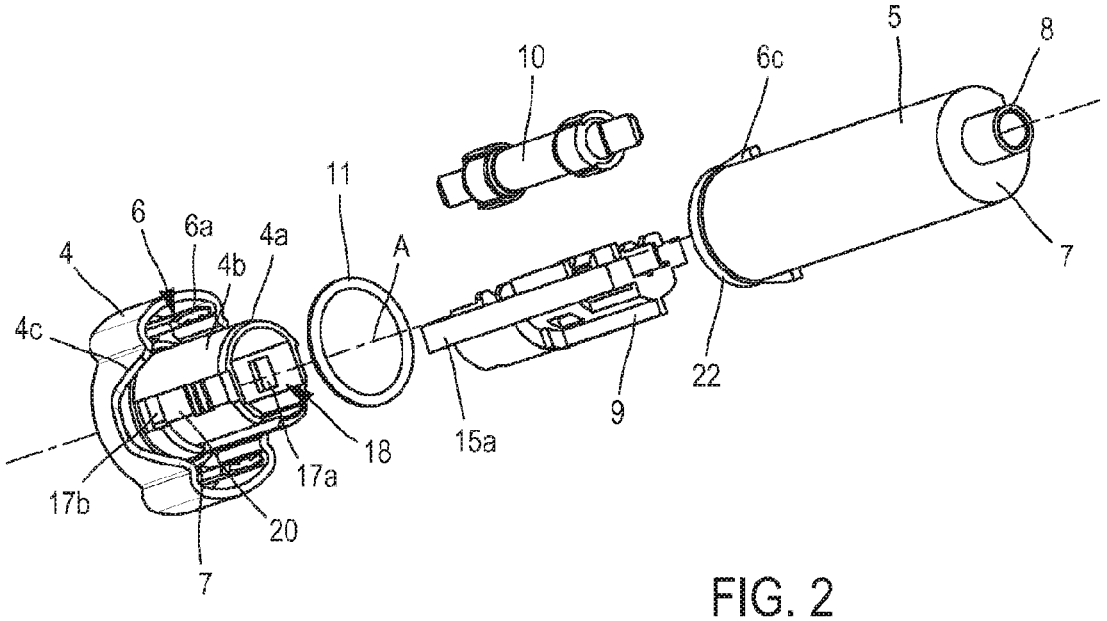
FIG. 2 represents diagrammatically in perspective an exploded view of the fuse holder from FIG. 1.

As represented in FIG. 2, this fuse holder 1 includes, in addition to the contacts 3 and the first and second housing elements 4 and 5, a fuse support 9, a fuse 10 and an O-ring seal 11. The fuse 10 is accommodated in the support 9, itself accommodated in the tube consisting of the first housing element 4 and the second housing element 5 assembled together. The seal 11, mounted on the first housing element 4, is inserted between the first housing element 4 and the second housing element 5, in the manner of an interfacial seal, in order to provide the seal between them (see FIGS. 4 and 5). Here the locking feature 6 consist of two diametrically opposite elastic attachments 6*a* on the first housing element 4 each including a respective notch 6*b* into which clips a lug 6*c* correspondingly situated on the second housing element 5 (see FIG. 5).

The first housing element 4 essentially consists of a substantially cylindrical cap 4*a* with an external face 4*b* partially surrounded by a skirt 4*c*. The locking feature 6 are partially covered by a rim consisting of a skirt 4*c*.

Figure 3A:
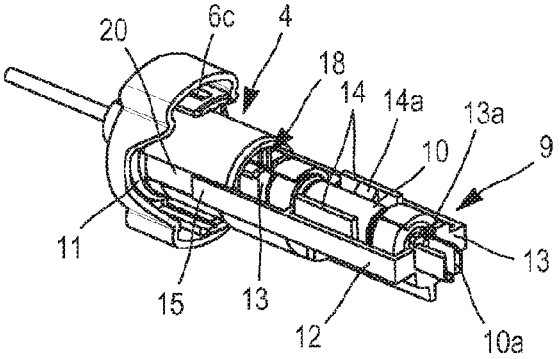
FIGS. 3A and 3B represent diagrammatically, in perspective, a support mounted on a housing element of the fuse holder from FIGS. 1 and 2, with the support respectively in the open position and in the closed position.

As represented in FIG. 3A, the support 9 is in the shape of a cradle with two side walls 12 extending longitudinally between two flanges 13. Two elastic lateral lugs 14 each extend from a respective side wall 12. Each of these lateral lugs 14 includes a detent 14*a* to form a feature for retaining a fuse 10 in its support 9.

The support 9 also includes a guiding and retaining feature 15 (FIG. 3A). These include two diametrically opposite lugs 15*a* each including a respective hook 15*b* intended to retain or to lock the support 9 onto the first housing element 4 (see FIG. 4) in posterior openings 17*a* (open position of the support 9) or anterior openings 17*b* (closed position of the support 9). These two lugs 15*a* constitute a guiding feature that enable the support 9 to be guided and positioned precisely relative to the first housing element 4. These two lugs 15*a* also constitute a seal retaining feature for retaining the seal 11 on the first housing element 4. The seal retaining feature 15 is integral with the support 9.

Figure 3B:
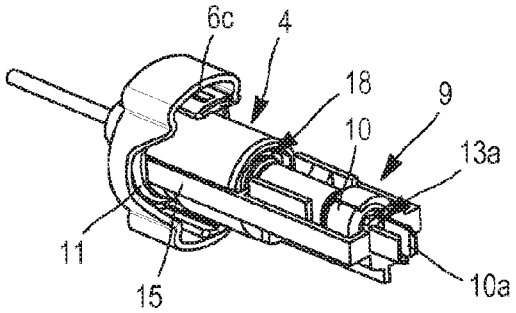

FIGS. 3A and 3B respectively show the open and closed positions of the support 9 on the first housing element 4. In the position corresponding to FIG. 3A, the support 9 is in an open or pre-locked position. In this position the fuse 10 can be introduced into the support 9 without having to demount the latter from the first housing element 4. The support 9 is retained, but mobile, on the first housing element 4 because the hooks 15*b* remain engaged in the posterior openings 17*a*. Because the support 9 does not have to be completely demounted from the first housing element 4 to introduce the fuse 10 into the latter, the seal 11 continues to be retained on the cap 4*a* by the lugs 15*a*.

When the fuse 10 is correctly positioned between the lateral lugs 14, under the detents 14*a* and with the terminals 10*a* inserted in the slots 13*a*, the support 9 can be moved longitudinally, toward its closed position, inside a cavity 18 in the cap 4*a* of the first housing element 4 and leading to an opening. During this movement, the lugs 15*a* slide in diametrically opposite grooves 20 disposed longitudinally on the external face 4*b* of the cap 4*a* (see FIG. 2). Accordingly, on insertion of the support 9 into the first housing element 4, the latter is inevitably correctly oriented, so that the opening of the female contact 3, which is accommodated in the first housing element 4, is aligned with the corresponding terminal 10*a*.

In this closed position of the support 9 the second housing element 5 can be threaded onto the support 9 and around the cap 4*a*, to be locked by the locking feature 6. As can be seen in FIG. 1 in particular, the second housing element 5 includes poka yoke feature 16 enabling an operative to orient it correctly relative to the support 9. Accordingly, upon its insertion onto the support 9, the second housing element 5 is inevitably correctly oriented, and so the opening of the female contact 3 that is accommodated therein is aligned with the corresponding terminal 10*a*.

Figure 4:
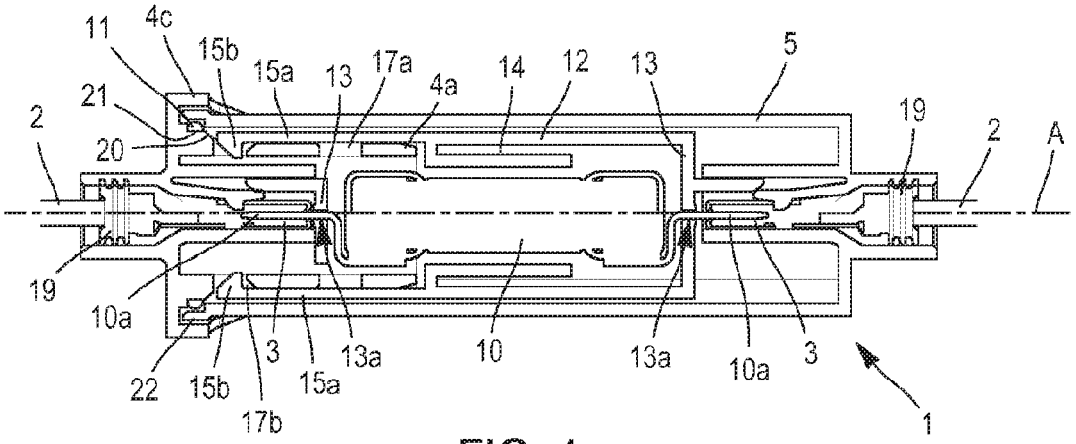
FIG. 4 represents diagrammatically in longitudinal section on an axial plane the fuse holder from FIGS. 1 and 2.

As shown in FIG. 4, the first housing element 4 and the second housing element 5 assembled in this way form a closed tube that is sealed by the interfacial seal 11 and the individual wire seals 19 crimped with the cables portions 2 onto the contacts 3.

As can also be seen in FIG. 4, the seal 11 is disposed on the cap 4*a* essentially in a plane perpendicular to the assembly direction A. It is covered by the second housing element 5 when the first and second housing elements 4, 5 are assembled together.

The first housing element 4 includes a beveled surface 20, situated under the rim consisting of the skirt 4*c*. It flares in an assembly direction corresponding to the insertion of a portion of the second housing element 5 under this rim. This beveled surface 20 forms a ramp for leading the interfacial seal 11 onto a seating 21 when assembling the first housing element 4 and the second housing element 5 together.

The second housing element 5 includes a flared opening 22 into which the seating 21 and the seal 11 are inserted.

The seal 11 is therefore at least in part protected by the rim consisting of the skirt 4*c*. This rim extending on the one hand all around the cap 4*a* and on the other hand in the direction of assembly of the first housing element 4 and the second housing element 5 to each other. The seal 11 is therefore protected even when the second housing element 5 is not assembled with the first housing element 4. Moreover, the lugs 15*a* are able to retain the seal 11 on the first housing element 4, under the skirt 4*c*, when the support 9 is in the closed position (which advantageously corresponds to the shipping position of the assembly consisting of the first housing element 4 and the support 9).

Figure 5:
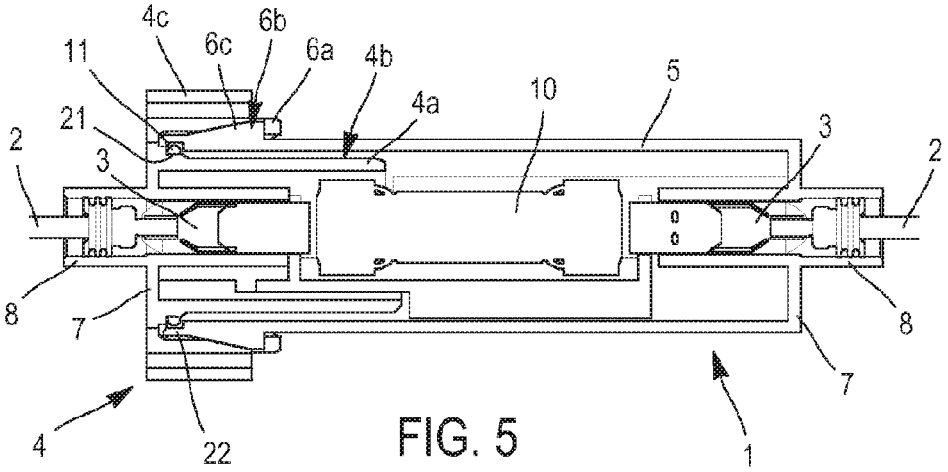
FIG. 5 represents diagrammatically in longitudinal section on an axial plane perpendicular to that of FIG. 4 the fuse holder from FIGS. 1 and 2.

It can equally be seen in FIGS. 4 and 5 that the second housing element 5 snugly surrounds the support 9 in which the fuse 10 is precisely accommodated, which the fuse 10 is itself connected to contacts 3 firmly and reliably locked in their respective housing.

A fuse holder 1 with a single support 9 for a single fuse 10 has been described above, but in accordance with variants the fuse holder 1 in accordance with the invention may include either a single support 9 but one that is able to accommodate a plurality of fuses 10 or a plurality of supports 9 each accommodating one or more fuses 10. All these variants may have one or more of the features defined in the claims.

The invention claimed is:

1. A fuse holder, comprising:

a first and second housing element which, once assembled, are configured to accommodate a fuse;

a cap integrally formed with the first or second housing element and extending longitudinally in a direction of assembly of the first and second housing elements;

a locking feature having a first part situated on the first housing element and having a second part situated on the second housing element and configured to retain the first and second housing elements assembled together and to form a tube closed at each of its ends by a wall including a passage for a cable portion;

a seal disposed on the cap essentially in a plane perpendicular to an assembly direction and covered by the second housing element when the first and second housing elements are locked together; and a seal retaining feature movable between an open position and a closed position, wherein the seal retaining feature is integral with a support in which the fuse is accommodated, wherein the seal retaining feature includes two opposed lugs each having a hook configured to lock the support to the first housing element, and wherein the seal is retained on the first housing element when the first and second housing elements are not assembled together.

2. The fuse holder in accordance with claim 1, wherein the seal is an O-ring seal.

3. The fuse holder in accordance with claim 1, wherein the first and second housing elements each includes a contact intended to make an electrical connection with a terminal of the fuse and electrically connected to a cable and wherein the first and second housing elements each include a cable passage and a wire seal inserted between the cable and the cable passage.

4. The fuse holder in accordance with claim 1, wherein the first housing element essentially consists of the cap and a rim integrally molded with the cap extending all around the cap and in the direction of assembly of the first and second housing elements with each other.

5. The fuse holder in accordance with claim 4, wherein the first and second parts of the locking feature engage with each other to lock the first and second housing elements when they are assembled together and wherein the locking feature is at least partly covered by the rim.

6. The fuse holder in accordance with claim 4, wherein the first housing element includes a beveled surface situated at least in part under the rim and flared in the assembly direction corresponding to insertion of a portion of the second housing element under the rim, wherein the beveled surface forms a ramp for leading the seal onto a seating on assembling the first and second housing elements together.

7. The fuse holder in accordance with claim 6, wherein the second housing element includes a flared opening into which are inserted the seating and the seal situated on the first housing element.

* * * * *